United States Patent [19]

Garraffa, Jr.

[11] 4,315,597

[45] Feb. 16, 1982

[54] WATER PRE-HEATER OF A REFRIGERATION SYSTEM

[76] Inventor: Jerome Garraffa, Jr., 60 Simmons Dr., East Islip, N.Y. 11730

[21] Appl. No.: 792,511

[22] Filed: May 2, 1977

[51] Int. Cl.[3] ..... G05D 23/00

[52] U.S. Cl. ..... 237/2 B; 62/238.6

[58] Field of Search ..... 237/2 B; 62/238, 436, 62/435, 324 D, 238 E, 238.6; 165/106

[56] References Cited

U.S. PATENT DOCUMENTS

| | | | |
|---|---|---|---|
| 2,049,155 | 7/1936 | Coleman | 165/106 X |
| 2,102,940 | 12/1937 | Buchanan | 62/238 |
| 2,125,842 | 8/1938 | Eggleston | 126/361 X |
| 2,418,446 | 4/1947 | Anderson | 62/238 X |
| 2,700,279 | 1/1955 | Stickel | 62/238 X |
| 2,819,044 | 1/1958 | Bungas | 165/106 X |
| 3,976,123 | 8/1976 | Davies | 62/238 X |
| 3,984,050 | 10/1976 | Gustafsson | 237/2 B |
| 4,012,920 | 3/1977 | Kirschbaum | 237/2 B X |

*Primary Examiner*—William E. Wayner

*Attorney, Agent, or Firm*—Bauer & Amer

[57] ABSTRACT

The heat discharge of a refrigeration system, otherwise lost, is salvaged to pre-heat water, but in a manner which safeguards against possible contamination of the water by the refrigerant. To this end, the "closed" refrigeration system is duplicated by an equally "closed" water circulation system, and coils of each are disposed in heat exchange relation to enable the pre-heating of the water by the heat discharge of the refrigerant. Most significant, however, contamination would require that the refrigerant leak out of its coil through a defect therein and further pass into the water coil through a defect therein, a most unlikely occurrence.

2 Claims, 2 Drawing Figures

WATER PRE-HEATER OF A REFRIGERATION SYSTEM

Figure 1:
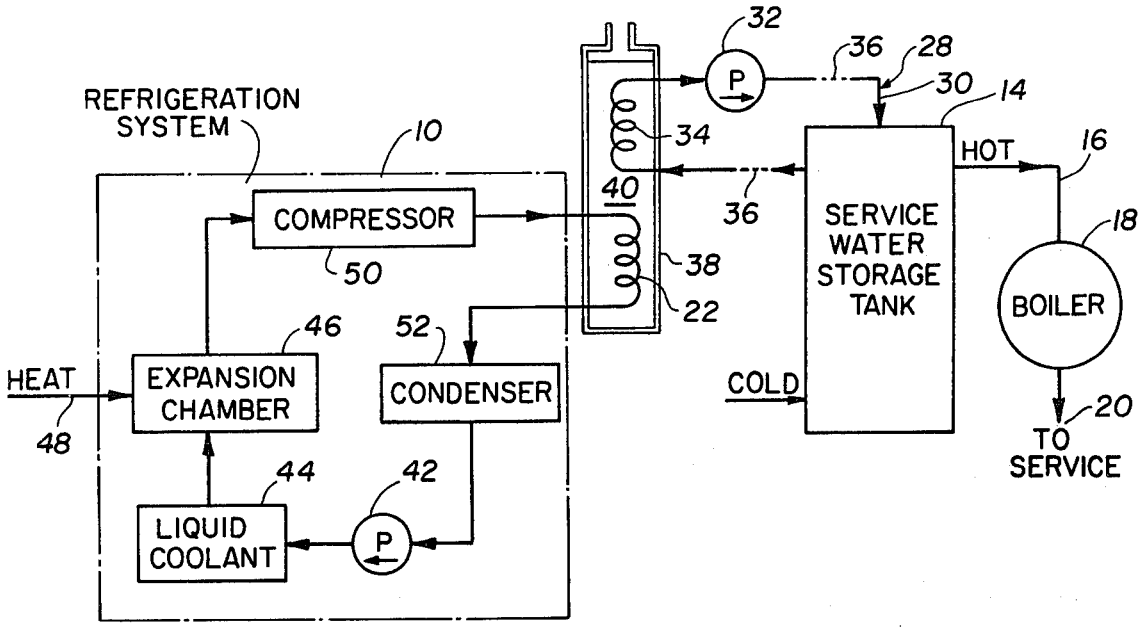

The present invention relates generally to the extended use of a refrigeration system to pre-heat water, and more particularly to improvements for a water pre-heater using salvaged heat of a refrigeration system in which the possibility of contamination of the water is minimized, as well as other noteworthy benefits obtained.

It is already well known, as exemplified by U.S. Pat. No. 3,301,002, that by suitable arrangements, a refrigerant of an air conditioning or similar apparatus can effectively be used to pre-heat water. That is, the heat released during the phase change of the refrigerant from vapor to liquid, as occurs in what is typically called the condenser coil of the system, obviously is better used to pre-heat water than merely being discharged to atmosphere without any beneficial result. Thus, in the apparatus of the referred to patent and other similar patents, the heat-discharging condenser coil is immersed in the storage volume of water thereby effectuating heat transfer to the water. The direct heat transfer relation between the condenser coil and water, as just noted, while efficient as far as promoting maximum heat transfer, is not entirely satisfactory from a health hazard viewpoint. A defect in the condenser coil could conceivably result in the refrigerant contaminating the water.

Broadly, it is an object of the present invention to provide an improved water pre-heater of a refrigeration system overcoming the foregoing and other shortcomings of the prior art. Specifically, it is an object to provide effectively sealed environments for the heat-exchanging refrigerant and water, thereby obviating contamination of the water by the refrigerant. Moreover, in maintaining the refrigerant and water systems separate and distinct as a solution to the contamination problem, it has been found in practice that another prior art restriction, namely a limitation on the size of the water source facility, is also obviated, all as will be subsequently explained in detail.

A refrigeration system effectively used to pre-heat water without danger of contamination demonstrating objects and advantages of the present invention includes a refrigeration system condenser coil, i.e. a sealed flow passage for the refrigerant of said system in which it changes from its vapor phase into its liquid phase and thus releases heat, a water storage tank at a remote location from said condenser coil containing a volume of water desirably raised to an elevated temperature preparatory to use and, as a counterpart for the condenser coil, there is further included a water circulation system for continuously circulating the water of said stored volume which system has a heat exchange coil that also defines a sealed flow passage for the circulating water. These two coils are provided with an operative position in adjacent relation to each other. Disposed in enclosing relation about the adjacently located condenser and heat exchange coils is a housing defining a heat exchanger having a heat exchange fluid in which the coils are immersed to thereby cause the released heat of the condenser coil to be transferred to the water circulating through the heat exchange coil. In this way, the circulating water is pre-heated prior to service during its sealed confinement within the heat exchange coil by heat salvaged from the refrigerant in sealed confinement within the condenser coil, and the walls bounding these two coils serve as physical barriers preventing contamination therebetween.

Figure 2:
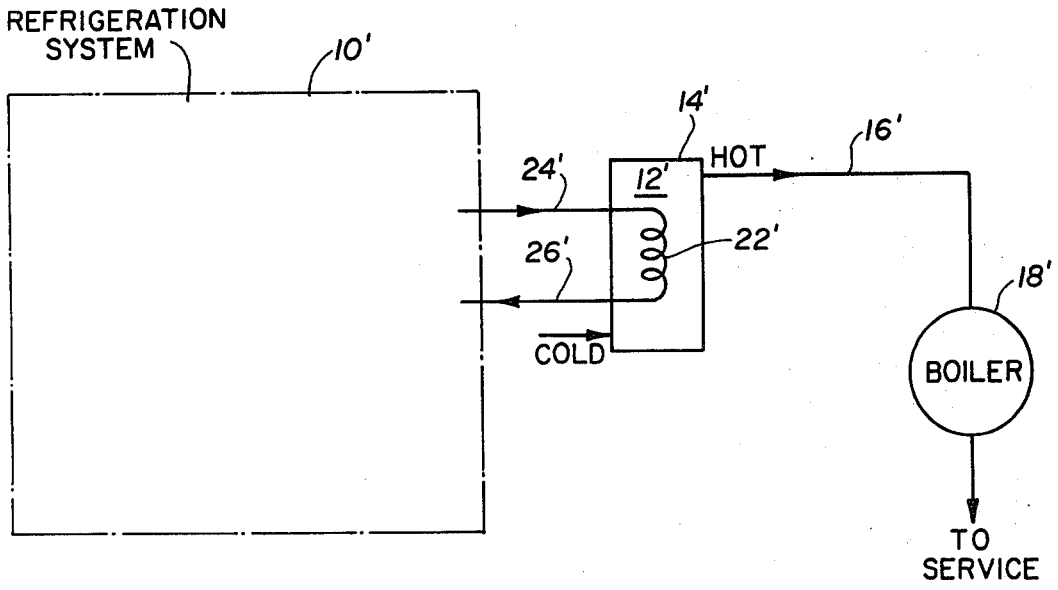
FIG. 2 PRIOR ART

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 1 is a diagrammatic view of the improved water pre-heater of a refrigeration system according to the present invention; and FIG. 2 is a diagrammatic view of the prior art that the arrangement of FIG. 1 is an improvement over, a comparison therebetween being helpful in an understanding of the present invention.

Illustrated in FIG. 1 is an improved manner for salvaging heat from a typical refrigeration system, generally designated 10, for the purpose of pre-heating a volume of water 12 in a remotely located storage tank 14 preparatory to the use thereof. Further, in the event that the pre-heated water 12 from the tank 14 is not at a sufficiently elevated temperature, it is proposed that the exiting flow thereof through the conduit 16 be directed to a boiler 18 for purposes of supplementing the heat input prior to delivery of the water to service, as at a selected location 20.

To better appreciate the improvements which comprise the within invention, which subsequently will be described in detail, it is helpful to first refer to FIG. 2 which illustrates a typical prior art arrangement, also of a refrigeration system and thus designated by the same but primed reference numerals, in which heat is also salvaged for the identical purpose of pre-heating a service volume of water 12' of a storage tank 14' preparatory to the use thereof. The pre-heated water of this prior art system is also readily permitted to exit through conduit 16' to a boiler 18' in order to attain a properly elevated temperature at its point of use 20'. To achieve the pre-heating, a condenser coil 22' of the refrigeration system 10' is immersed in the stored body of water 12'. As understood, it is within the condenser coil 22' that the refrigerant changes from its vapor phase into its liquid phase and, in so doing, releases heat. It is this released heat which tranfers to the water body 12' and thus provides the efficiency associated with the pre-heating of the water. Although, as indicated, the pre-heating constitutes an element of efficiency in that it obviously represents that much less heat input that must be supplied by the boiler 18', the prior art arrangement of FIG. 2 nevertheless has significant shortcomings. Among these is the fact that the condenser coil 22' is, as illustrated, immersed directly in the body of the water 12', that typically is destined for human consumption or other such purposes which requires safeguard against contamination. Yet, if the coil 22' is defective in its sealed confinement of the refrigerant, there will obviously be contamination of the water 12' by refrigerant leaking from the coil 22'.

Another significant shortcoming of the prior art arrangement of FIG. 2 is that the heat exchange relation between the condenser coil 22' directly with the water 12' of necessity requires the location of the storage tank 14' in close proximity to the refrigeration system 10'. That is, it is not advisable that the inlet and outlet conduit connections 24', 26' of the condenser coil 22' be of considerable length. This, of necessity, thus requires that the coil 22′ be located near the other components of the refrigeration system 10′ and thus also in close proximity to the storage tank 14′. Unfortunately, refrigeration system 10′, such as is typically used in a supermarket or other type of establishment, is not typically installed in a location where there is excess room. Thus, the space available adjacent the refrigeration system 10′ usually cannot accommodate a storage tank 14′ of any considerable size, and thus a prior art water pre-heater system often has an undesirably small capacity.

Representing a significant improvement over the FIG. 2 prior art system, as just described, the water pre-heater of the present invention, and as illustrated in FIG. 1, provides both significant safeguard against contamination, and also can readily utilize a large-size storage tank 14 because the location of such tank, being remote from the refrigeration system 10, can be at a selected site where there is adequate room for the tank. It will now be explained how these and other advantages are achieved using the arrangement shown in FIG. 1.

Refrigeration system 10, like system 10′, also includes a condenser coil 22 in which the refrigerant changes from its vapor into its liquid phase and thus releases heat. In accordance with the present invention, it is further recognized that the coil 22 effectively defines a sealed flow passage for the refrigerant, thus minimizing contamination by the refrigerant. In all fairness, however, this much was also achieved in the prior art system, although it was not advantageously utilized to the extent that it is in the arrangement of FIG. 1, as will soon become apparent. As an addition to the water storage facility, and particularly the water storage tank 14, the contemplated improvement is a continuous water circulation system, generally designated 28, including a closed loop conduit 30 for the recirculating water, a pump 32 to provide the pressure for urging the water continuously through circulating movement, and a heat exchange coil 34. It has been indicated by a drafting convention, as at 36, that it is intended that the conduits 30 have significant length so as to enable providing the storage tank 14 with a location remote from the refrigeration system 10, all to the end of achieving the objective of providing an appropriate site for the tank 14 where space requirements do not limit the size thereof.

The heat exchange coil 34 of the system 28 also defines, like the coil 22, a sealed flow passage, not for the refrigerant, but for the water 12 of the storage tank 14. Thus in order for the refrigerant of coil 22 to contaminate the water of coil 34, it would be necessary for the refrigerant to both leak out of the coil 22 through defects and pass into the coil 34, also through defects, a most unlikely coincidence of circumstances.

As may be readily appreciated from FIG. 1, heat exchange coil 34 has an operative position in adjacent relation to the coil 22. Disposed about the adjacently located coils 34, 22 is a thermally insulated housing 38 defining a heat exchanger. In the internal volume bounded by the housing 38 there is provided a body 40 of a heat exchange fluid, which is preferably plain water. Since both the condenser coil 22 and the water heat exchange coil 34 are immersed in the body of the heat exchange fluid 40, the heat released from coil 22 is effectively transferred, via fluid body 40, to the heat exchange coil 34, thereby effectively pre-heating the water that is continuously circulating through the system 28 and thus through the heat exchange coil 34. In this manner, the water storage volume 12 is pre-heated without danger of contamination by the refrigerant flowing through the condenser coil 22, and is also available in a volume unrestricted by space requirements imposed on the size of the storage tank 14.

Although the components of a typical refrigeration system 10, 10′ are well known, for completeness sake a brief description will now be provided.

As generally understood, such system includes a pump 42 which delivers the liquid coolant or refrigerant from a suitable source 44 to an expansion chamber 46. In chamber 46, the refrigerant changes from its liquid phase into its vapor phase and, in the process, absorbs heat 48 which, of course, is obtained from the area to be refrigerated, thereby lowering the temperature thereof to a level which provides the desired refrigeration effect. Next, the refrigerant is compressed by a compressor 50, and in the process again changes phase, this time from liquid into vapor. This phase change occurs in a condenser 52 and, more particularly and primarily in the previously noted condenser coil 22 thereof. Also as already noted, during this phase change heat is released from the refrigerant thereby effectively elevating the temperature of the heat transfer fluid 40 which then releases this heat to the cooler water being continuously recirculated through the heat exchange coil 34 of the water circulation system 28. It is thus in this manner that the water 12 being stored in the remotely located tank 14 is effectively pre-heated prior to use. To the extent that it is pre-heated, this therefore requires less supplementation of heat by the boiler 18, and thus significantly contributes to the efficient operation of a combination refrigeration system and water pre-heater.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. A refrigeration system advantageously used to pre-heat water without danger of contamination, comprising a condenser coil of said refrigeration system defining a sealed flow passage for the refrigerant of said system during change thereof from its vapor phase into its liquid phase and thus when it releases heat, a water storage tank at a remote location from said condenser coil containing a volume of water desirably raised to an elevated temperature preparatory to use, a boiler operatively effective to primarily heat said volume of water, a water circulation system for supplementing the heat input to said volume of water consisting of a closed conduit loop for continuously circulating the water of said stored volume, a heat exchange coil defining a sealed flow passage for said circulating water disposed in said closed conduit loop having an operative position in adjacent relation to said condenser coil, a pump disposed in said closed conduit loop effective to produce flowing movement in said water for a selected distance so as to contribute to a remote location of said water storage tank in relation to said condenser coil, a heat exchange housing disposed in enclosing relation about said adjacently located condenser and heat exchange coils, and a heat exchange fluid in said heat exchange housing immersing both said condenser and heat exchange coils to thereby cause said released heat of said condenser coil to be transferred to said water circulating through said heat exchange coil, whereby said circulating water is pre-heated prior to service during its sealed confinement within said heat exchange coil by heat salvaged from said refrigerant in sealed confinement within said condenser coil.

2. A water pre-heater of a refrigeration system as claimed in claim 1 wherein said heat exchange housing is thermally insulated to minimize heat loss from said heat exchange fluid.

* * * * *